US006966717B1

(12) United States Patent
Kuo

(10) Patent No.: US 6,966,717 B1
(45) Date of Patent: Nov. 22, 2005

(54) PEN WITH CHANGEFUL PENHOLDER

(76) Inventor: Chin-Yi Kuo, No. 29, Lane 14, Ho Ping Rd., Panchiao, Taipei Hsien (TW)

( * ) Notice: Subject to any disclaimer, the term of this patent is extended or adjusted under 35 U.S.C. 154(b) by 0 days.

(21) Appl. No.: 10/908,588

(22) Filed: May 18, 2005

(51) Int. Cl.[7] ..... B43K 29/00
(52) U.S. Cl. ..... 401/195
(58) Field of Search ..... 401/52, 195

(56) References Cited

U.S. PATENT DOCUMENTS 4,983,062 A * 1/1991 Hour ..... 401/195
5,186,562 A * 2/1993 Yoshinaga et al. ..... 401/112
5,433,642 A * 7/1995 Chia ..... 446/71
6,612,766 B2 * 9/2003 Collins ..... 401/88
6,739,780 B1 * 5/2004 Kuo ..... 401/195

* cited by examiner

*Primary Examiner*—David J. Walczak
(74) *Attorney, Agent, or Firm*—Pai Patent & Trademark Law Firm; Chao-Chang David Pai

(57) ABSTRACT

A pen with changeful penholder is comprised of multiple decoration rings disposed around the penholder and an elastic retaining mechanism inserted either at the front or the tail of the penholder. The decoration rings are held closely in series when subject to restriction by the elastic retaining mechanism, and released to turn around freely when the elastic retaining mechanism is compressed. The outer wall of each decoration ring is preset with any color, symbol, stripe or shape to change the form and appearance of the penholder when the decoration rings are turned around to achieve diversified combination of decoration styles as desired.

8 Claims, 7 Drawing Sheets

PEN WITH CHANGEFUL PENHOLDER

BACKGROUND OF THE INVENTION (a) Field of the Invention

The present invention relates generally to pens with changeful penholders and, more particularly, to pens with penholders having decoration rings that can be turned around to create different combinations of colors, shapes and patterns on the surface of the decoration rings.

(b) Description of the Prior Art

A ball pen, steel ball pen, automatic pen, marker, or color pen generally available in the market has its fixed style either in the construction, the appearance or the form of the penholder. The pen just looks dull and lacks variations. Therefore a pen cannot be identified easily among other pens of various users unless the individual user has particularly marked with a symbol or a sticker on the pen. However, it is impossible to change the appearance or to create personal style on the conventional pen.

This inventor filed a U.S. patent application titled with "Pen with Variable Penholder Styles" with application Ser. No. 10/671,627 on Sep. 29, 2003; wherein, it provided multiple decoration rings abutted to one another around the penholder and limited respectively at the front and the tail of the penholder to change the appearance of the penholder by turning those decoration rings as desired. However, a proper tightness is required for those decoration rings when abutted to one another to allow relative turning while staying flushed against one another; meanwhile a tolerance must be provided to avoid sliding of the decoration rings.

SUMMARY OF THE INVENTION

The primary purpose of the present invention is to provide a pen with changeful penholder to hold those multiple decoration rings together in normal status and to allow them to be released for free turning to create versatile recombination of colors, symbols, stripes or forms printed or engraved on the surface of those decoration rings. To achieve the purpose, an elastic retaining mechanism is provided either to the front or the tail of the penholder so that those multiple decoration rings when inserted onto the penholder are restricted in position by the elastic retaining mechanism; and if any change of the appearance of the penholder is desired, the elastic retaining mechanism is pushed to release those multiple decoration rings for free recombination.

Another purpose of the present invention is to provide a pen with changeful penholder that allows fast release of those decoration rings from the elastic retaining mechanism. To achieve the purpose, the elastic retaining mechanism disposed to the front or the tail of the penholder includes an outer ring, an elastic member, and an inner ring. The elastic member is sandwiched by both the outer and the inner ring that are coupled to each other. When the elastic retaining mechanism is pushed, a relative displacement is created between the inner ring and the outer ring, thus releasing the decoration rings from the elastic retaining mechanism.

Yet another purpose of the present invention is to provide a pen with changeful penholder that allows even more diversified recombination of those decoration rings. To achieve the purpose, the decoration ring may be made in circular, triangular, rectangular, square, polygonal, or any other regular or irregular forms; and the surface of the decoration ring is given any color, symbol, stripe or form as desired; or is provided with a recess to be inlaid with a matching decoration plate.

Yet another purpose of the present invention is to provide a pen with changeful penholder that allows fast separation among those decoration rings when released from the elastic retaining mechanism and to be secured in position when restricted by the elastic retaining mechanism. To achieve the purpose, multiple matching slots and recesses are provided respectively on the inner walls of the front and the tail of the decoration ring.

Yet another purpose of the present invention is to provide a pen with changeful penholder, wherein multiple ratchet slots are provided on the inner wall of the decoration rings and a circular gap is reserved between the top of the slot and the end of the decoration ring while one or more bits are reserved on the penholder at locations in relation to the circular gap. Accordingly, in its normal status of the penholder, those decoration rings are held in position by inserting the bits into the ratchet slot and when the elastic retaining mechanism is pushed, those multiple decoration rings are released since the circular gap is aligned with the bits of the penholder.

DETAILED DESCRIPTION OF THE PREFERRED EMBODIMENTS

Figure 1:
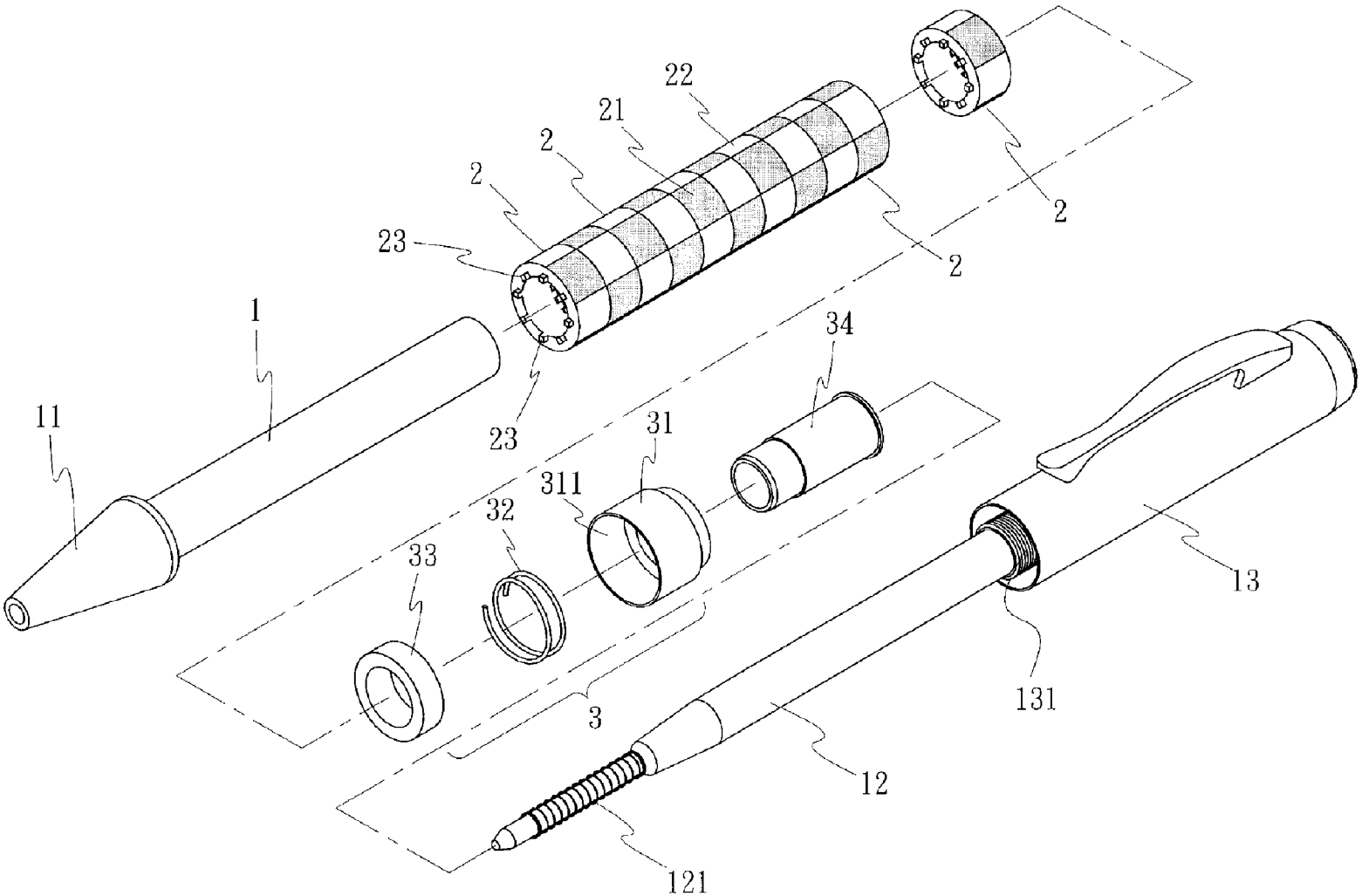
FIG. 1 is an exploded view of a preferred embodiment of the present invention.
Figure 2:
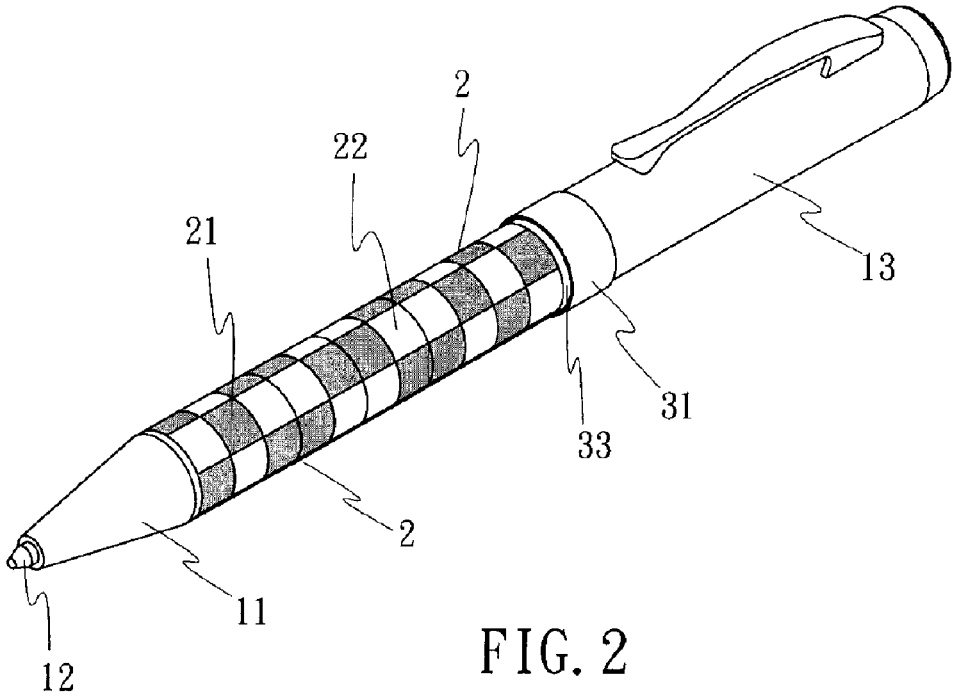
FIG. 2 is a perspective view of the preferred embodiment of the present invention.
Figure 3:
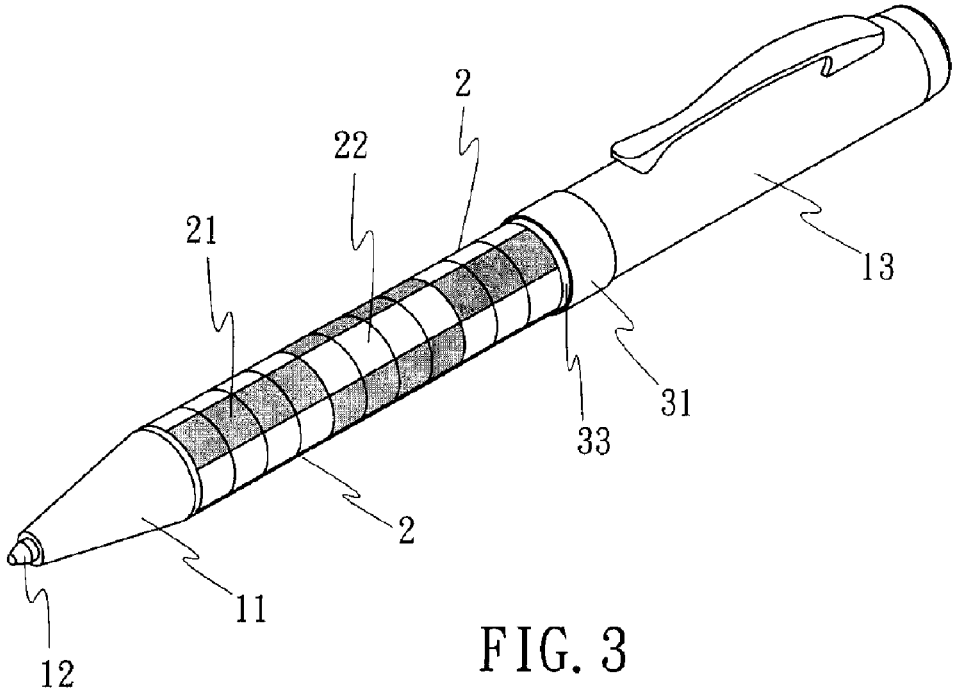
FIG. 3 is a perspective view showing an appearance of a penholder of the preferred embodiment of the present invention after recombination of multiple decoration rings.
Figure 4:
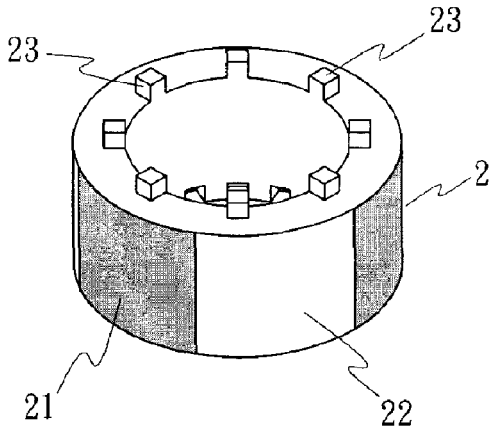
FIG. 4 is a perspective view of a decoration ring of the preferred embodiment of the present invention.
Figure 5:
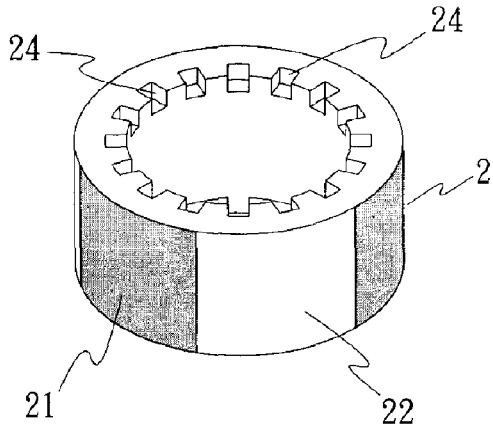
FIG. 5 is a perspective view of the decoration ring of FIG. 4 when placed upside down.

Referring to FIGS. 1, 2, and 3, a pen with changeful penholder of the present invention comprises a penholder 1, multiple decoration rings 2 and an elastic retaining mechanism 3. Therein, the penholder 1 is a hollow tube having disposed at its front end a graded conic sheath 11 to allow penetration by a refill 12. Multiple decoration rings 2 fitted onto the penholder 1 in sequence may be each made in the form of a ring as illustrated, a triangle, a rectangle, polygon, or any other regular or irregular form as desired; and any color, symbol, stripe, pattern or form may be provided to the outer wall of each ring 2. In the preferred embodiment, two colors 21, 22 are alternatively provided on the outer wall. Each ring 2 has on its end walls at the front and the tail provided with multiple matching bits 23 and recesses 24 as illustrated in FIGS. 4 and 5 for those multiple rings 2 to be tightly abutted to one another in series. The elastic retaining mechanism 3 includes an outer ring 31, an elastic member 32, and an inner ring 33. The outer ring 31 is internally provided with a graded hole 311 to accommodate in sequence insertion of the elastic member 32 and the inner ring 33. Thus the outer ring 31 and the inner ring 33 are coupled to each other with the elastic member 32 being sandwiched between the outer ring 31 and the inner ring 33. The elastic member 32 may be an extension coil or an elastic plate. Accordingly, when the outer and the inner rings 31, 33 are pushed and pressed together, a relative displacement is created due to the elastic member 32. When required, an additional sleeve 34 may be provided to insert through the outer ring 31 to connect the refill 12, a cap 13 of the pen may be disposed at the terminal of the penholder 1 or a rotation drive member 131 may be provided in the cap 13 of the pen.

Figure 6:
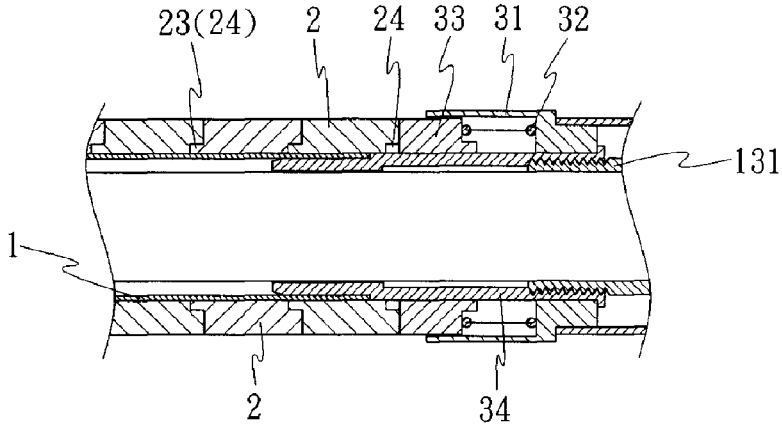
FIG. 6 is a sectional view showing an elastic retaining mechanism together with multiple decoration rings of the preferred embodiment of the present invention.
Figure 7:
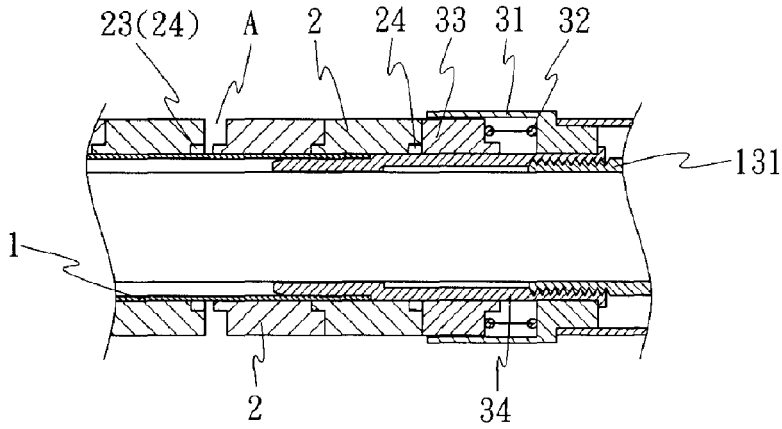
FIG. 7 is a sectional view showing multiple decoration rings of the preferred embodiment of the present invention when released from the elastic retaining mechanism.

As illustrated in FIG. 6, those multiple decoration rings 2 are inserted in sequence onto the penholder 1; the elastic retaining mechanism 3 is incorporated to the front or the tail of the penholder (to the tail of the penholder in the preferred embodiment) for those multiple decoration rings 2 to be abutted to one another as they are restricted by the elastic retaining mechanism 3. For adjustment, a series of decoration rings 2 are pushed towards the elastic retaining mechanism 3 to further push the inner ring 33 into the graded hole 311 of the outer ring 31, thus other decoration rings 2 are released from the elastic retaining mechanism 3 for fast separation from one another as illustrated in FIG. 7. As a result, a gap A is created to allow free rotation for those multiple decoration rings 2. Whereas the outer wall of each of those multiple decoration rings 2 is designed with certain colors, symbols, stripes, patterns or forms, those decoration rings 2 can be recombined to give different appearance of the penholder 1 at the discretion of the user as respectively illustrated in FIGS. 1 and 2. The penholder 1 can obtain various appearances by fully taking advantage of diversified colors and patterns of those decoration rings 2.

Figure 8:
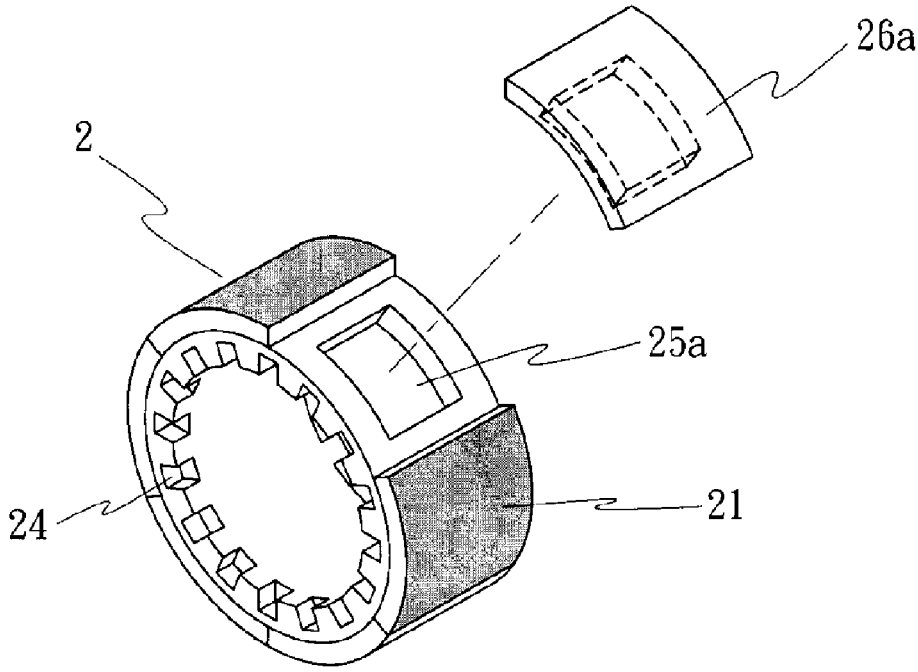
FIG. 8 is an exploded view of a decoration ring of the preferred embodiment of the present invention.
Figure 9:
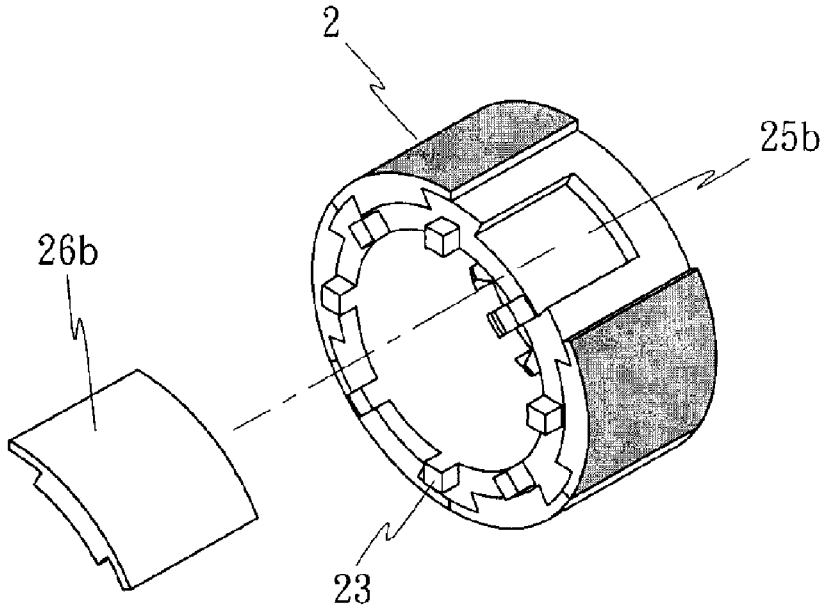
FIG. 9 is an exploded view of another type of decoration ring of the preferred embodiment of the present invention.
Figure 10:
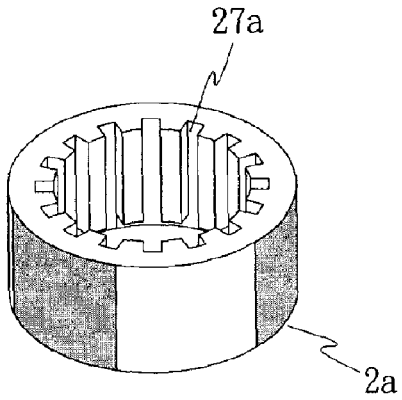
FIG. 10 is a perspective view of yet another type of decoration ring of the preferred embodiment of the present invention.
Figure 11:
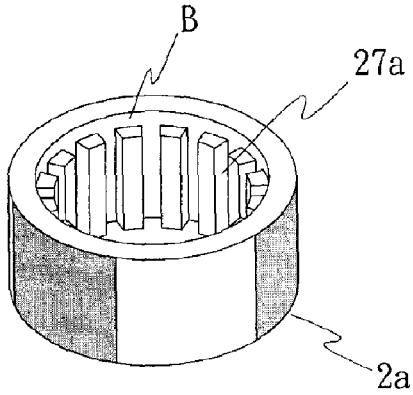
FIG. 11 is a perspective view showing the decoration ring of FIG. 10 when placed upside down.

Now referring to FIG. 8 or 9, a recess 25*a* or 25*b* is further provided on the surface of each decoration ring 2 to receive matching decoration plate 26*a* or 26*b*. The surface of the decoration plate 26*a* or 26*b* can be printed or engraved with any color, pattern, letter, symbol, or lines to give the decoration plate 26*a* or 26*b* even more diversified changes. Furthermore, the decoration plate 26*a* or 26*b* is replaceable to create even more personal styles and promote sense of self-identification.

Figure 12:
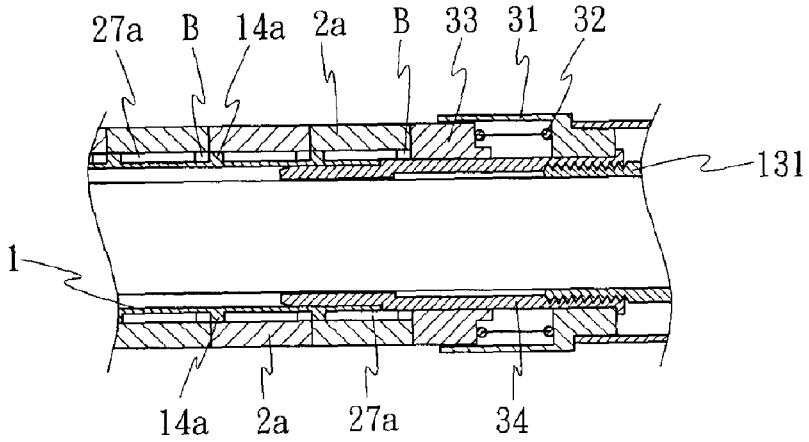
FIG. 12 is a schematic view of a cutaway from another preferred embodiment of the present invention.
Figure 13:
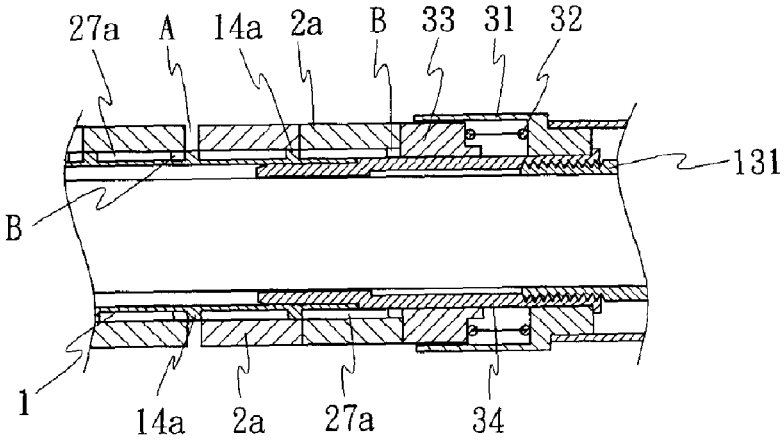
FIG. 13 is a schematic view showing a cutaway of those multiple decoration rings of the second preferred embodiment when released from the elastic retaining mechanism.

As illustrated in FIGS. 10 through 13, another preferred embodiment of the present invention comprises a penholder 1, multiple decoration rings 2*a*, and an elastic retaining mechanism 3. Therein, the inner wall of each decoration ring 2*a* is provided with multiple ratchet slots 27*a* and a circular gap B is reserved between one end of the decoration ring 2*a* and the top of the ratchet slots 27*a*. Meanwhile, one bit or multiple bits (or protruding ring) 14*a* is reserved on the penholder 1 at locations in relation with the circular gap B. When the elastic retaining mechanism 3 is pushed, the circular gap B is at locations corresponding to the bit 14*a* of the penholder so that those decoration rings 2*a* are released from the restriction by the elastic retaining mechanism 3 as illustrated in FIG. 13 while leaving a gap A. When those decoration rings 2*a* are in their normal status without being pushed, the bit 14*a* is inserted into and secured in the ratchet slot 27*a* as illustrated in FIG. 12.

Figure 14:
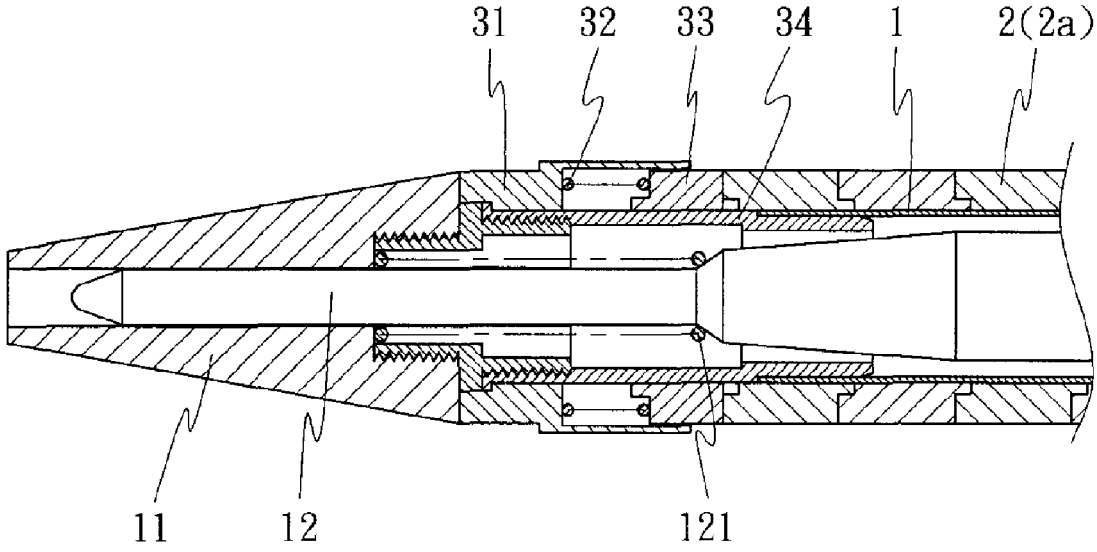
FIG. 14 is a sectional view showing a cutaway of the elastic retaining mechanism disposed at the front of the penholder.

Though the elastic retaining mechanism 3 is incorporated to the tail of the penholder 1 as illustrated in the aforesaid preferred embodiments, it can be provided to the front of the penholder 1 as illustrated in FIG. 14 as long as the elastic member 32 and the inner ring 33 are inserted in sequence into the outer ring 31 for the outer ring 31 and the inner ring 33 to be coupled to each other before inserting the sleeve 34 through the coupled outer and inner rings 31, 33. By having the sleeve 34 connected to the refill 12 and the conic sheath 11, the elastic retaining mechanism 3 is incorporated to the front end of the penholder 1 to hold those multiple decoration rings abutted to one another in series when subject to the restriction by the elastic retaining mechanism 3.

Figure 16:
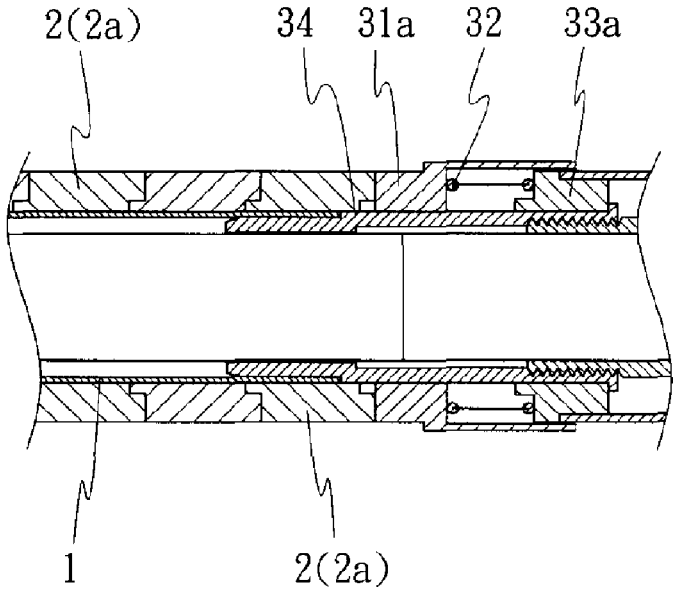
FIG. 16 is a sectional view showing a cutaway of the preferred embodiment shown in FIG. 15.
Figure 15:
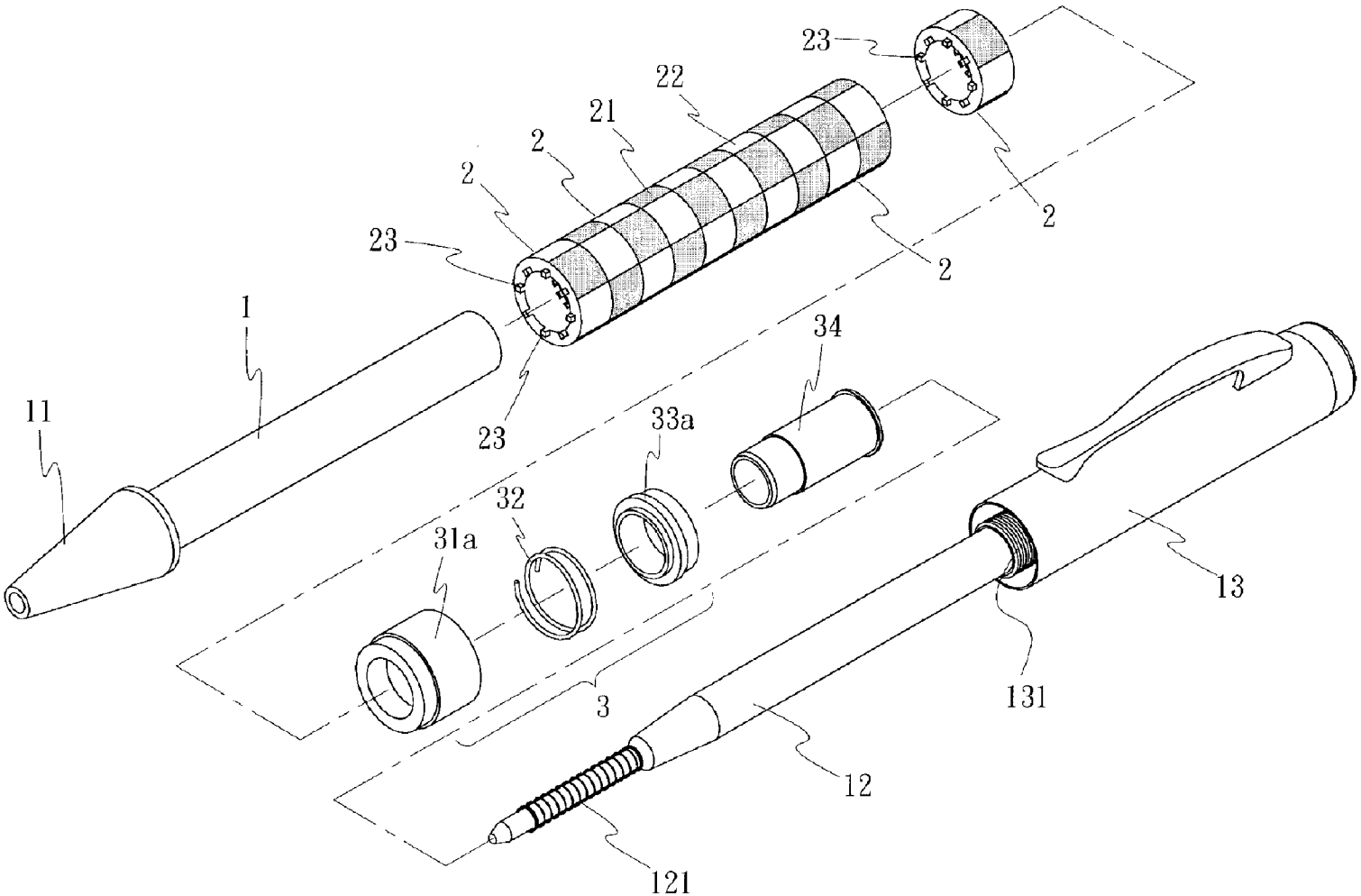
FIG. 15 is an exploded view of an elastic retaining mechanism of yet another preferred embodiment of the present invention.

In yet another preferred embodiment of the present invention as illustrated in FIGS. 15 and 16, an outer ring 31*a* and an inner ring 33*a* of the elastic retaining mechanism 3 are coupled to each other in opposite direction to contain the elastic member 32 and receive insertion of the sleeve 34 for the outer ring 31*a* to hold against the decoration ring 2, and further to create relative displacement when the elastic retaining mechanism 3 is pushed to release the decoration ring 2.

Any of the preferred embodiments of the present invention disclosed herein relates to an automatically retractable pen. The rotation drive member 131 contained in the cap 13 of the pen is locked to the sleeve 34, and a smaller coil 121 is inserted into the front of the refill 12. However, it is to be noted that the present invention is also applicable to any type of penholder.

What is claimed is:

1. A pen with changeful penholder comprising a penholder, which is a hollow tube accommodating a refill;

a plurality of decoration rings disposed in sequence around the penholder and abutting one another; and an elastic retaining mechanism including an outer ring, an elastic member, and an inner ring, the outer ring being internally provided with a graded hole, the elastic member and the inner ring being placed in sequence into the graded hole, and the elastic member being sandwiched between the outer ring and the inner ring that are coupled to each other, wherein the elastic retaining mechanism is inserted to the front or the tail of the penholder;

the plurality of decoration rings abut one another as they are restricted by the elastic retaining mechanism;

and the plurality of decoration rings can be released from the elastic retaining mechanism for adjustment when the elastic retaining mechanism is compressed.

2. The pen with changeful penholder of claim 1, wherein a graded conic sheath is disposed to the front of the penholder.

3. The pen with changeful penholder of claim 1, wherein the outer wall of each of the decoration rings is provided with a color, symbol, stripe or form.

4. The pen with changeful penholder of claim 1, wherein the outer walls of the decoration rings are alternately provided in different colors.

5. The pen with changeful penholder of claim 1, wherein the end walls at the front and the tail of the decoration rings are respectively provided with multiple matching bits and recesses.

6. The pen with changeful penholder of claim 1, wherein a sleeve is inserted through the elastic retaining mechanism to connect the refill and a cap of the pen at the terminal of the penholder or a rotation drive member in the cap of the pen.

7. The pen with changeful penholder of claim 1, wherein a recess is provided on at least one of the decoration rings to be inlaid with a matching decoration plate.

8. The pen with changeful penholder of claim 1, wherein multiple ratchet slots are provided on the inner wall of each of the decoration rings, a circular gap is reserved between the ratchet slots and one end of each of the decoration rings, and at least one bit is provided on the penholder at locations in relation to the circular gaps such that when the elastic retaining mechanism is compressed the circular gaps correspond in position to the bits of the penholder.

* * * * *